US006931994B2

(12) United States Patent
Lloyd

(10) Patent No.: US 6,931,994 B2
(45) Date of Patent: Aug. 23, 2005

(54) TANDEM WARHEAD

(75) Inventor: Richard M. Lloyd, Melrose, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/301,302

(22) Filed: Nov. 21, 2002

(65) Prior Publication Data

US 2005/0126421 A1 Jun. 16, 2005

Related U.S. Application Data

(60) Provisional application No. 60/406,828, filed on Aug. 29, 2002.

(51) Int. Cl.[7] ..... F42B 12/58

(52) U.S. Cl. ..... 102/489; 102/491; 102/492; 102/497; 102/517

(58) Field of Search ..... 102/489, 491, 102/492, 497, 517, 518

(56) References Cited

U.S. PATENT DOCUMENTS

| | | | | |
|---|---|---|---|---|
| 1,198,035 | A | 9/1916 | Huntington | 102/504 |
| 1,229,421 | A | 6/1917 | Downs | 102/504 |
| 1,235,076 | A | 7/1917 | Stanton | 102/504 |
| 1,244,046 | A | 10/1917 | Ffrench | 102/494 |
| 1,300,333 | A | 4/1919 | Berry | 102/383 |
| 1,305,967 | A | 6/1919 | Hawks | 102/494 |
| 2,296,980 | A | 9/1942 | Carmichael | 102/504 |
| 2,308,683 | A | 1/1943 | Forbes | 102/504 |
| 2,322,624 | A | 6/1943 | Forbes | 102/504 |
| 2,337,765 | A | 12/1943 | Nahirney | |
| 2,925,965 | A | 2/1960 | Pierce | 89/135 |
| 2,988,994 | A | 6/1961 | Fleischer, Jr. et al. | 102/306 |
| 3,332,348 | A | 7/1967 | Myers et al. | 102/369 |
| 3,565,009 | A | 2/1971 | Allred et al. | 102/475 |
| 3,656,433 | A | 4/1972 | Tbrailkill et al. | 102/455 |
| 3,665,009 | A | 5/1972 | Diskinson, Jr. | 548/369.7 |
| 3,757,694 | A | 9/1973 | Talley et al. | 102/495 |
| 3,771,455 | A | 11/1973 | Haas | 102/377 |
| 3,796,159 | A | 3/1974 | Conger | 102/492 |
| 3,797,359 | A | 3/1974 | Mawhinney et al. | 89/1.8 |
| 3,818,833 | A | 6/1974 | Throner, Jr. | 102/389 |
| 3,846,878 | A | 11/1974 | Monson et al. | |
| 3,851,590 | A | 12/1974 | LaCosta | |
| 3,861,314 | A | 1/1975 | Barr | |
| 3,877,376 | A | 4/1975 | Kupelian | 102/492 |
| 3,902,424 | A | 9/1975 | Dietsch et al. | |
| 3,903,804 | A | 9/1975 | Luttrell et al. | |

(Continued)

FOREIGN PATENT DOCUMENTS

| | | |
|---|---|---|
| DE | 3327043 A1 | 2/1985 |

(Continued)

OTHER PUBLICATIONS

U.S. Appl. No. 10/384,804, filed Mar. 10, 2003, Lloyd.

(Continued)

*Primary Examiner*—Jack Keith
(74) *Attorney, Agent, or Firm*—Iandiorio & Teska

(57) ABSTRACT

A tandem warhead for destroying a target, the tandem warhead including a kinetic energy rod section with a plurality of lengthy individual projectiles, a blast fragmentation section deployable proximate the target, and a guidance subsystem for deploying the projectiles of the kinetic energy rod section first in the trajectory path of the target and for deploying the blast fragmentation section second proximate the target.

12 Claims, 7 Drawing Sheets

U.S. PATENT DOCUMENTS

| | | | | |
|---|---|---|---|---|
| 3,915,092 | A | 10/1975 | Monson et al. | |
| 3,941,059 | A | 3/1976 | Cobb | 102/510 |
| 3,949,674 | A | 4/1976 | Talley | 102/476 |
| 3,954,060 | A | 5/1976 | Haag et al. | 102/494 |
| 3,977,330 | A * | 8/1976 | Held | 102/210 |
| 4,026,213 | A | 5/1977 | Kempton | 102/475 |
| 4,036,140 | A | 7/1977 | Korr et al. | 102/438 |
| 4,089,267 | A | 5/1978 | Mescall et al. | 102/491 |
| 4,106,410 | A | 8/1978 | Borcher et al. | 102/495 |
| 4,147,108 | A | 4/1979 | Gore et al. | |
| 4,172,407 | A | 10/1979 | Wintink | 89/1.56 |
| 4,210,082 | A | 7/1980 | Brothers | 102/401 |
| 4,211,169 | A | 7/1980 | Brothers | 102/494 |
| 4,231,293 | A | 11/1980 | Dahn et al. | |
| 4,289,073 | A | 9/1981 | Romer et al. | 102/476 |
| 4,376,901 | A | 3/1983 | Pettibone et al. | 310/10 |
| 4,430,941 | A | 2/1984 | Raech, Jr. et al. | 102/496 |
| 4,455,943 | A | 6/1984 | Pinson | 102/489 |
| 4,516,501 | A | 5/1985 | Held et al. | 102/496 |
| 4,538,519 | A | 9/1985 | Witt et al. | 102/387 |
| 4,638,737 | A | 1/1987 | McIngvale | 102/489 |
| 4,655,139 | A | 4/1987 | Wilhelm | 102/494 |
| 4,658,727 | A | 4/1987 | Wilhelm et al. | 102/491 |
| 4,676,167 | A | 6/1987 | Huber, Jr. et al. | 102/393 |
| 4,745,864 | A | 5/1988 | Craddock | 102/491 |
| 4,770,101 | A | 9/1988 | Robertson et al. | 102/489 |
| 4,777,882 | A | 10/1988 | Dieval | 102/489 |
| 4,848,239 | A * | 7/1989 | Wilhelm | 102/492 |
| 4,922,826 | A | 5/1990 | Busch et al. | 102/489 |
| 4,957,046 | A | 9/1990 | Puttock | |
| 4,995,573 | A | 2/1991 | Wallow | |
| 4,996,923 | A | 3/1991 | Theising | 102/438 |
| H1047 | H | 5/1992 | Henderson et al. | 102/496 |
| H1048 | H | 5/1992 | Wilson et al. | 102/496 |
| 5,182,418 | A | 1/1993 | Talley | 102/475 |
| 5,223,667 | A | 6/1993 | Anderson | |
| 5,229,542 | A | 7/1993 | Bryan et al. | 102/491 |
| 5,313,890 | A | 5/1994 | Cuadros | 102/496 |
| 5,370,053 | A | 12/1994 | Williams et al. | 102/262.5 |
| 5,524,524 | A | 6/1996 | Richards et al. | 89/1.13 |
| 5,535,679 | A | 7/1996 | Craddock | 102/494 |
| 5,542,354 | A * | 8/1996 | Sigler | 102/478 |
| 5,544,589 | A | 8/1996 | Held | 102/492 |
| 5,577,431 | A | 11/1996 | Küsters | 89/1.51 |
| 5,578,783 | A | 11/1996 | Brandeis | 89/8 |
| 5,583,311 | A | 12/1996 | Rieger | 89/1.11 |
| 5,622,335 | A | 4/1997 | Trouillot et al. | |
| D380,784 | S | 7/1997 | Smith | |
| 5,670,735 | A | 9/1997 | Ortmann et al. | 102/202 |
| 5,691,502 | A | 11/1997 | Craddock et al. | 102/494 |
| 5,796,031 | A | 8/1998 | Sigler | |
| 5,823,469 | A | 10/1998 | Arkhangelsky et al. | 244/3.22 |
| 5,929,370 | A | 7/1999 | Brown et al. | |
| 5,936,191 | A | 8/1999 | Bisping et al. | |
| 6,035,501 | A | 3/2000 | Bisping et al. | |
| 6,044,765 | A * | 4/2000 | Regebro | 102/213 |
| 6,186,070 | B1 * | 2/2001 | Fong et al. | 102/476 |
| 6,276,277 | B1 | 8/2001 | Schmacker | |
| 6,279,478 | B1 | 8/2001 | Ringer et al. | |
| 6,279,482 | B1 | 8/2001 | Smith et al. | |
| 6,598,534 | B2 | 7/2003 | Lloyd et al. | 102/494 |
| 6,622,632 | B1 | 9/2003 | Spivak | 102/475 |
| 6,666,145 | B1 | 12/2003 | Nardone et al. | 102/481 |
| 2003/0019386 | A1 | 1/2003 | Lloyd et al. | |
| 2004/0011238 | A1 | 1/2004 | Ronn et al. | |

FOREIGN PATENT DOCUMENTS

| | | |
|---|---|---|
| DE | 38 30 527 A1 | 3/1990 |
| DE | 3934042 A1 | 4/1991 |
| EP | 270 401 A1 | 6/1988 |
| FR | 2 678 723 | 1/1993 |
| FR | 2678723 A1 | 1/1993 |
| GB | 550001 | 12/1942 |
| GB | 2236581 | 4/1991 |
| JP | 1-296100 | 11/1989 |
| WO | WO 97/27447 | 7/1997 |

OTHER PUBLICATIONS

U.S. Appl. No. 10/385,319, filed Mar. 10, 2003, Lloyd.
U.S. Appl. No. 10/370,892, filed Feb. 20, 2003, Lloyd.
U.S. Appl. No. 10/456,391, filed Jun. 5, 2003, Lloyd et al.
U.S. Appl. No. 10/456,777, filed Jun. 6, 2003, Lloyd.
U.S. Appl. No. 10/698,500, filed Oct. 31, 2003, Lloyd.
U.S. Appl. No. 10/685,242, filed Oct. 14, 2003, Lloyd.
Richard M. Lloyd., "Physics of Direct Hit and Near Miss Warhead Technology", vol. 194, Progress in Astronautics and Aeronautics, Copyright 2001 by the American Institute of Aeronautics and Astronautics, Inc., Chapter 3, pp. 99-197.
Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 6, pp. 311-406.
Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 5, pp. 193-251.
Richard M. Lloyd, "Aligned Rod Lethality Enhanced Concept for Kill Vehicles", 10th AIAA/BMDD Technology Conf., Jul. 23-26, Williamsburg, Virginia, 2001, pp. 1-12.
U.S. Appl. No. 10/162,498, filed Jun. 4, 2002, Lloyd.
U.S. Appl. No. 10/301,420, filed Nov. 21, 2002, Lloyd.
FAS Military Analysis Network (http://www.fas,org/man/dod-101/sys/land/m546.htm): M546 APERS-T 105-mm, Jan. 21, 1999.
FAS Military Analysis Network (http://www.fas.org/man/dod-101/sys.land/bullets2.htm): Big Bullets for Beginners, Feb. 6, 2000.
U.S. Appl. No. 10/924,104, filed Aug. 23, 2004, Lloyd.
U.S. Appl. No. 10/938,355, filed Sep. 10, 2004, Lloyd.
U.S. Appl. No. 10/960,842, filed Oct. 7, 2004, Lloyd.

* cited by examiner

TANDEM WARHEAD

This application claims priority of U.S. Provisional Patent Application Ser. No. 60/406,828 filed Aug. 29, 2002.

FIELD OF THE INVENTION

This invention relates to a tandem warhead with kinetic energy rod warhead and blast fragmentation warhead sections.

BACKGROUND OF THE INVENTION

A blast fragmentation type warhead is designed to be carried by a missile and is used to destroy enemy missiles, aircraft, re-entry vehicles, and other targets. When the missile carrying the warhead reaches a position close to an enemy missile or other target, a pre-scored or pre-made band of metal on the warhead is detonated and pieces of metal are accelerated with high velocity and strike the target. See the textbook by the inventor hereof, R. Lloyd, "Conventional Warhead Systems Physics and Engineering Design," Progress in Astronautics and Aeronautics (AIAA) Book Series, Vol. 179, ISBM 1, 56347-255-4, 1998, incorporated herein by this reference, which provides additional details on conventional blast and pre-made fragmentation type warheads and other types of warheads.

The fragments of the blast fragmentation type warhead, however, are not always effective at destroying the target and biological bomblets and/or chemical submunition payloads can survive and still cause heavy casualties.

SUMMARY OF THE INVENTION

It is therefore an object of this invention to provide a more lethal warhead.

It is a further object of this invention to provide such a warhead has a better chance of destroying enemy targets including the biological bomblets and/or chemical submunition payloads they may carry.

This invention results from the realization that a more lethal warhead is effected by a tandem warhead design including both a kinetic energy rod section and a blast fragmentation section and a deployment sequence wherein the projectiles of the kinetic energy rod section are deployed in the trajectory path of the target and the carrier missile then continues towards the target deploying the blast fragmentation section proximate the target so that if any chemical or biological payloads remain intact after deployment of the blast fragmentation section, they are destroyed by the projectiles of the kinetic energy rod section.

This invention features a tandem warhead for destroying a target, the tandem warhead comprising a kinetic energy rod section including a plurality of lengthy individual projectiles, a blast fragmentation section deployable proximate the target, and means for deploying the projectiles of the kinetic energy rod section first in the trajectory path of the target and for deploying the blast fragmentation section second proximate the target.

In one example, the kinetic energy rod section includes an explosive charge about the projectiles, the explosive charge is divided into sections and there is a hull about the explosive charge also divided into sections. Typically, jettison explosive packs are disposed between each hull section and the projectiles. In one embodiment, the projectiles are cylindrical in cross section. Also, the projectiles may have at least one end which is pointed and/or may have a non-cylindrical cross section such as a star shaped cross section.

A method attacking a target in accordance with this invention includes first, deploying a plurality of projectiles in the trajectory path of the target, and second, positioning a blast fragmentation warhead proximate the target and initiating the blast fragmentation warhead so that any portions of the target which survive the blast fragmentation warhead are destroyed by the projectiles.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1A:
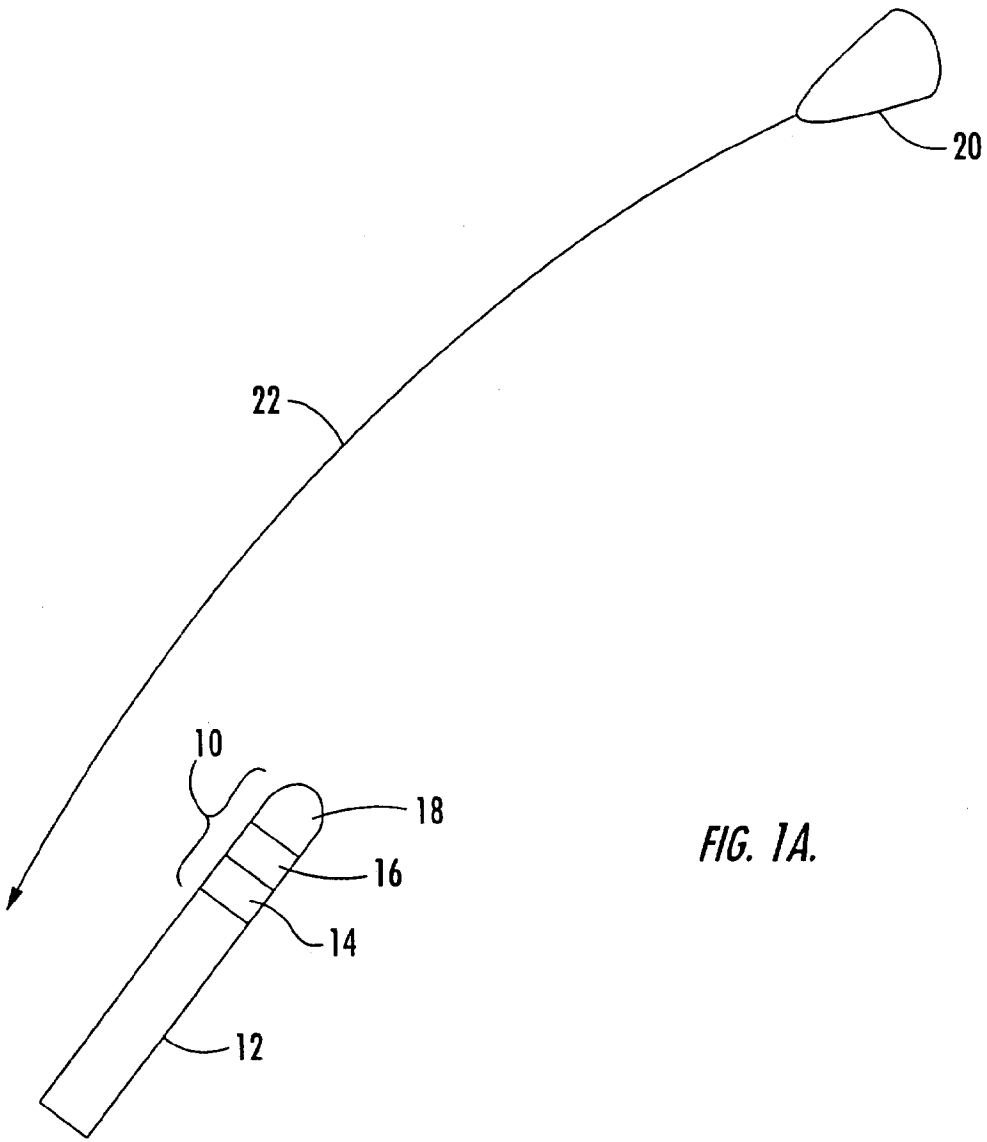
FIGS. 1A–1E schematically depict the sequence of operation of the tandem warhead of the subject invention.
Figure 1B:
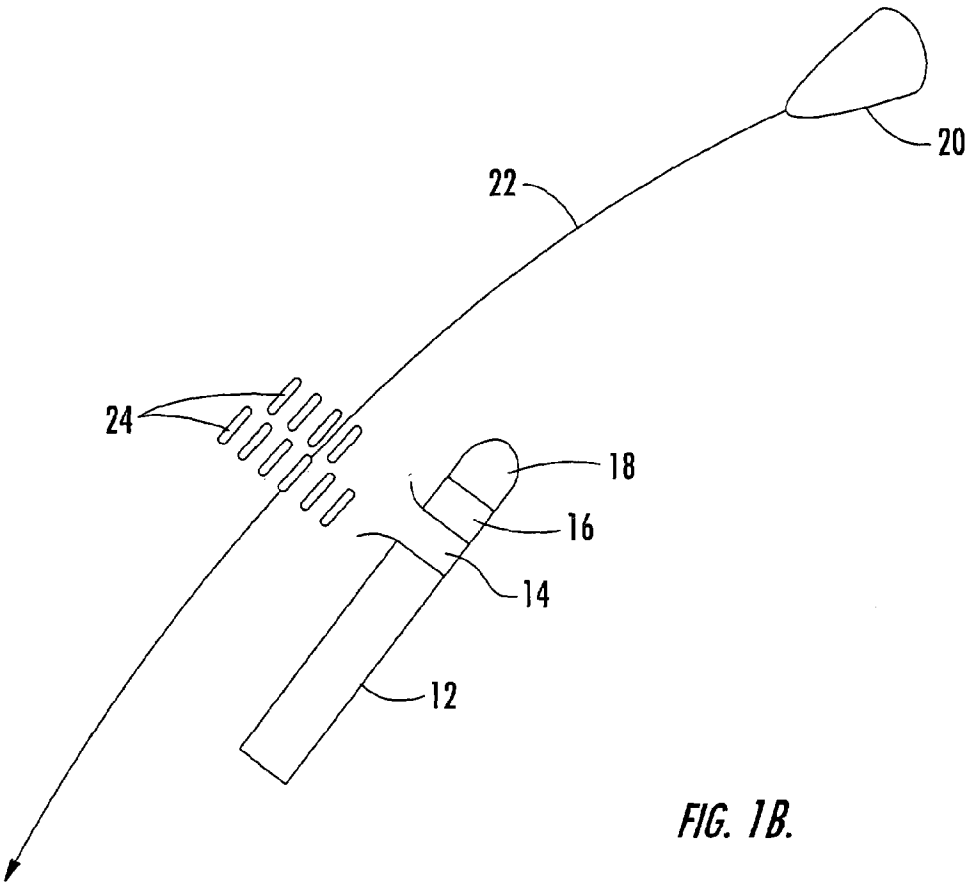
Figure 1C:
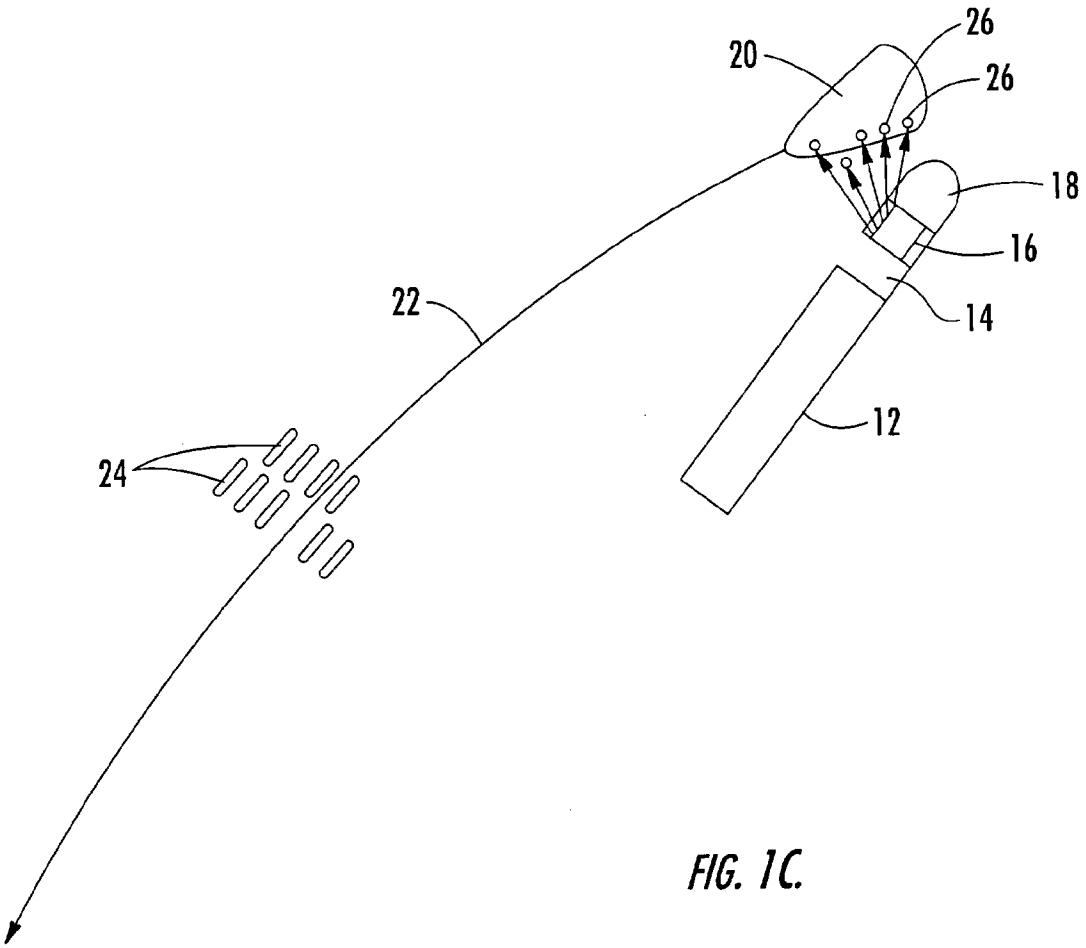

Tandem warhead 10, FIG. 1A carried by missile 12 and including kinetic energy rod section 14, blast fragmentation section 16, and guidance subsystem 18, is shown nearing target 20 having trajectory path 22. In FIG. 1B, guidance subsystem 18 serves as one means for initiating the deployment of kinetic energy rod section 14 deploying lengthy titanium, tantalum, or tungsten projectiles 24 in the trajectory path 22 of target 20 and then guidance subsystem 18 continues to guide missile 12 proximate target 20, FIG. 1C whereupon blast fragmentation section 16 is deployed and blast fragments 26 thereof strike target 20.

Figure 1E:
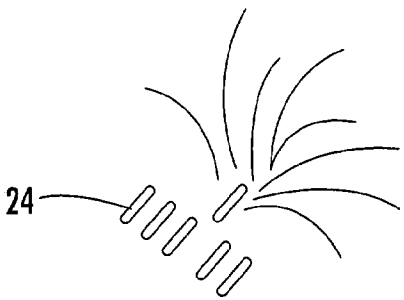
Figure 1D:
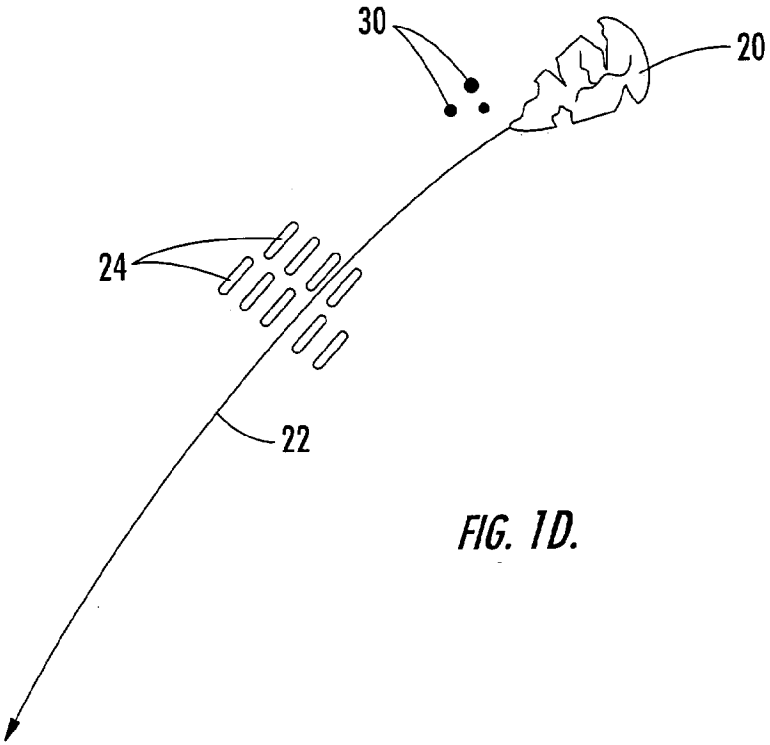

As shown in FIG. 1D, however, target 20 is not completely destroyed by blast fragmentation warhead 16 and submunitions 30 have survived the blast fragmentation engagement. But, projectiles 24 lie in the trajectory path of the submunitions and they are destroyed by projectiles 24 as shown in FIG. 1E.

Figure 2:
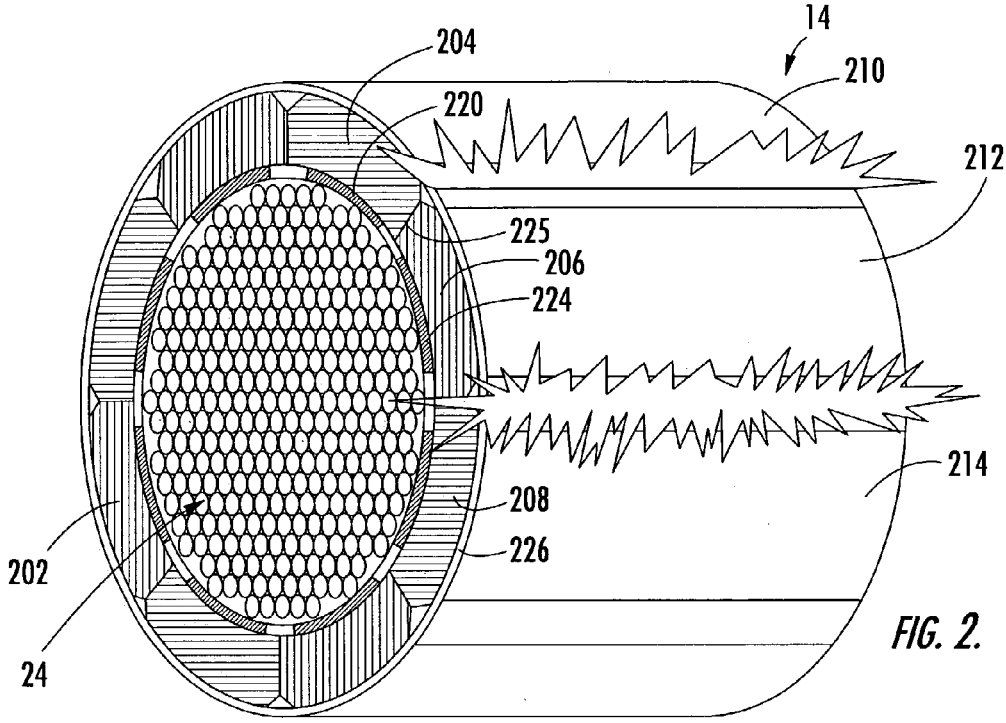
FIGS. 2–5 are schematic three-dimensional views showing the sequence of operation of one preferred kinetic energy rod section of the tandem warhead of this invention.
Figure 3:
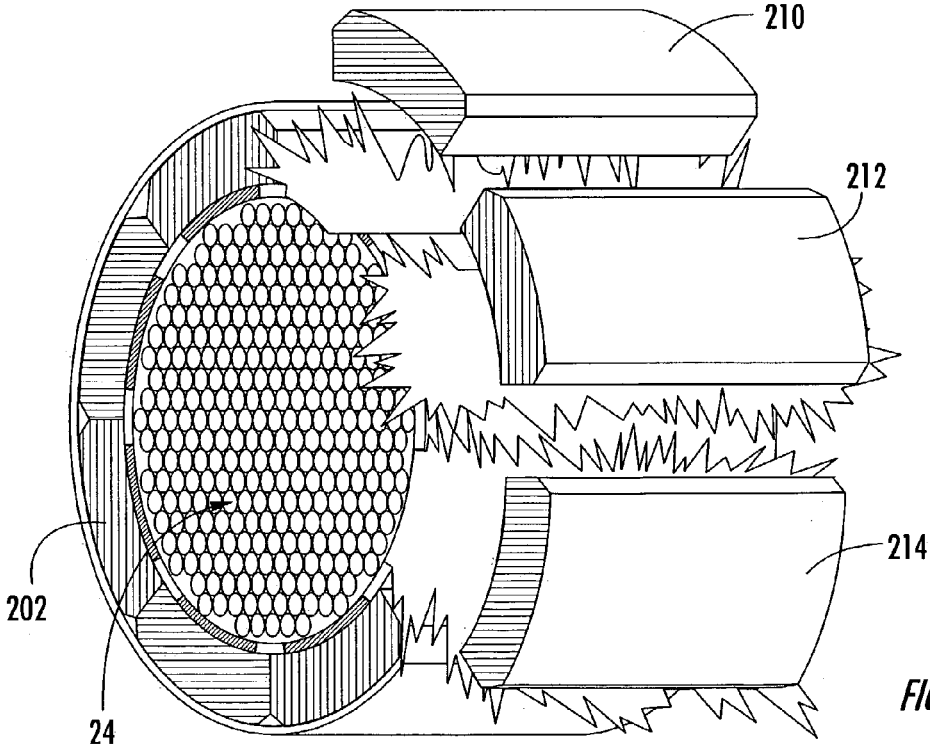
Figure 4:
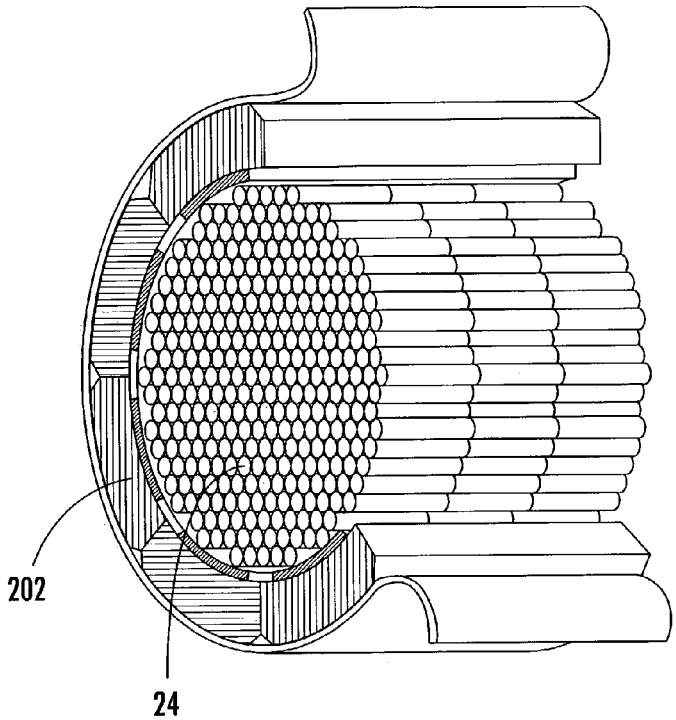
Figure 5:
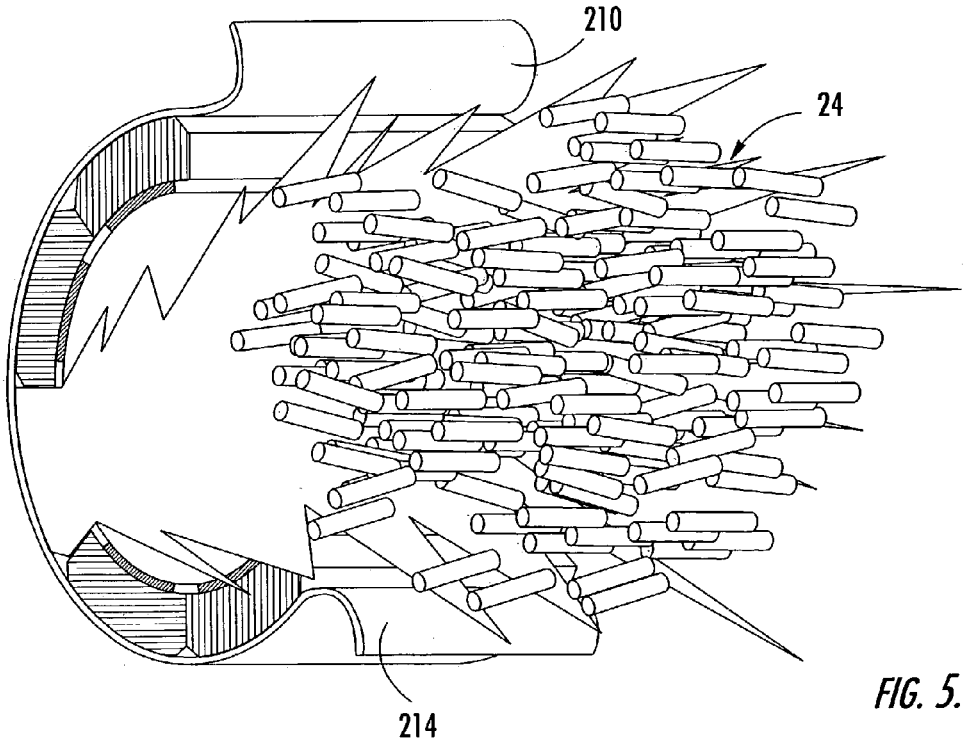

The result is a much more lethal warhead combining the lethality of a blast fragmentation warhead and a kinetic energy rod warhead in a novel way. Blast fragmentation warhead 16, FIG. 1A is conventional as is guidance subsystem 18 but the preferred kinetic energy rod warhead section is aimable and typically configured as shown in FIGS. 2–5. Kinetic energy rod warhead 14 includes an explosive charge divided into a number of sections 202, 204, 206, and 208. Shields such as shield 225 separate explosive charge sections 204 and 206. Shield 225 maybe made of a composite material such as a steel core sandwiched between inner and outer lexan layers to prevent the detonation of one explosive charge section from detonating the other explosive charge sections. Detonation cord resides between hull sections 210, 212, and 214 each having a jettison explosive pack 220, 224, and 226. High density projectiles 24 or rods 24 reside in the core or bay of warhead 200 as shown. To aim all of the rods 24 in a specific direction, the detonation cord on each side of hull sections 210, 212, and 214 is initiated as are jettison explosive packs 220, 222, and 224 as shown in FIGS. 2–3 to eject hull sections 210, 212, and 214 away from the intended travel direction of projectiles 24. Explosive charge section 202, FIG. 4 is then detonated as shown in FIG. 5 using a number of detonators to deploy projectiles 24 into the trajectory path of the target as shown in FIG. 1B. Thus, by selectively detonating two or three explosive charge sections, the projectiles are specifically aimed at the trajectory path of the target. Typically, the hull portion referred to in FIGS. 2–3 is either the skin of the carrier missile or a portion added to the missile or housed within it as a separate module.

Figure 6:
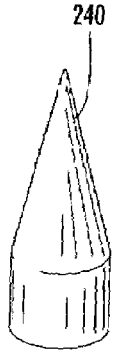
FIGS. 6–8 are schematic three-dimensional views showing examples of different projectile shapes for the kinetic energy rod section of the tandem warhead of this invention.
Figure 7:
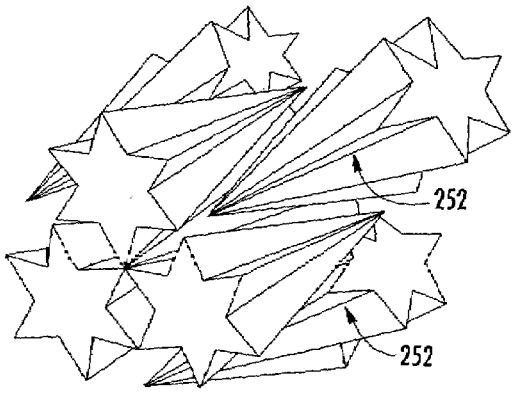
Figure 8:
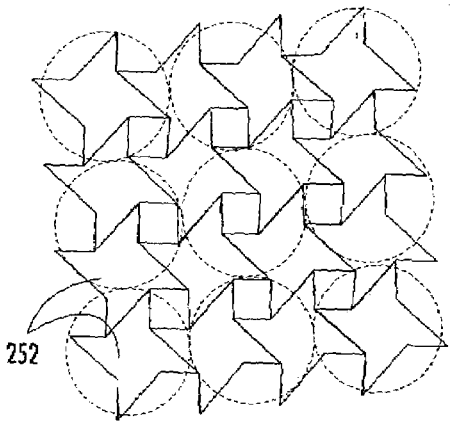

Preferred projectile designs for the kinetic energy rod section includes projectile 240, FIG. 6 with a pointed nose as shown or projectile 252, FIG. 7 having a star cross section and a pointed nose for higher lethality and better packaging density. As shown in FIG. 8, projectiles 252 each have a number of petals resulting in the ability to package many more projectiles in a given volume compared to projectiles having a cylindrical cross sectional shape shown in phantom in FIG. 8.

The result is a much higher lethality warhead design especially for the embodiment where the kinetic energy rod section is aimable to deploy the projectiles thereof in a specific direction and into the trajectory path 22, FIG. 1A of the target as shown in FIG. 1B and also wherein the projectiles have a non-cylindrical cross sectional shape and/or one end which is pointed. Further details concerning kinetic energy rod warheads are disclosed in copending U.S. patent application Ser. Nos. 09/938,022, 10/301,420, and 10/162,498 incorporated herein by this reference.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A tandem warhead for destroying a target, the tandem warhead comprising:

a kinetic energy rod section including a plurality of lengthy individual projectiles;

a blast fragmentation section deployable proximate the target; and means for deploying the projectiles of the kinetic energy rod section first in the trajectory path of the target and for deploying the blast fragmentation section second proximate the target.

2. The tandem warhead of claim 1 in which the kinetic energy rod section includes an explosive charge about the projectiles.

3. The tandem warhead of claim 2 in which the explosive charge is divided into sections.

4. The tandem warhead of claim 3 in which there is a hull about the explosive charge also divided into sections.

5. The tandem warhead of claim 4 further including jettison explosive packs disposed between each hull section and the projectiles.

6. The tandem warhead of claim 1 in which the projectiles are cylindrical.

7. The tandem warhead of claim 6 in which the projectiles have at least one end which is pointed.

8. The tandem warhead of claim 1 in which the projectiles have a non-cylindrical cross section.

9. The tandem warhead of claim 8 in which the projectiles have a star shaped cross section.

10. The tandem warhead of claim 8 in which the non-cylindrical cross section projectiles have a pointed end.

11. A tandem warhead for destroying a target, the tandem warhead comprising:

a kinetic energy rod section including a plurality of lengthy individual projectiles;

a blast fragmentation section deployable proximate the target; and means for deploying the projectiles of the kinetic energy rod section first away from a direction of travel of the blast fragmentation section and in the trajectory path of the target and for deploying the blast fragmentation section second proximate the target.

12. A tandem warhead for destroying a target, the tandem warhead comprising:

a kinetic energy rod section travelling in a first direction including a plurality of lengthy individual projectiles;

a blast fragmentation section also travelling in the first direction deployable proximate the target; and means for deploying the projectiles of the kinetic energy rod section in a second direction perpendicular to the first direction and in the trajectory path of the target and for deploying the blast fragmentation section, after further travel in the first direction, proximate the target.

* * * * *